US008095049B2

(12) United States Patent
Ishiguro et al.

(10) Patent No.: US 8,095,049 B2
(45) Date of Patent: Jan. 10, 2012

(54) TONER CARTRIDGE AND IMAGE FORMING APPARATUS USING THE SAME

(75) Inventors: Yasuyuki Ishiguro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 416 days.

(21) Appl. No.: 12/480,870

(22) Filed: Jun. 9, 2009

(65) Prior Publication Data

US 2010/0003056 A1 Jan. 7, 2010

(30) Foreign Application Priority Data

Jul. 1, 2008 (JP) ..... 2008-171974

(51) Int. Cl.
*G03G 15/08* (2006.01)

(52) U.S. Cl. ..... 399/263

(58) Field of Classification Search ..... 399/106, 399/258, 262, 263; 222/162, 336, 366, DIG. 1
See application file for complete search history.

(56) References Cited

U.S. PATENT DOCUMENTS

| | | | | |
|---|---|---|---|---|
| 6,971,421 | B2 | 12/2005 | Takagi | |
| 7,111,654 | B2 | 9/2006 | Takagi | |
| 7,116,928 | B2 * | 10/2006 | Muramatsu et al. | |
| 7,174,120 | B2 | 2/2007 | Koyama et al. | |
| 7,295,798 | B2 | 11/2007 | Koyama | |
| 7,409,180 | B2 * | 8/2008 | Seo | 399/258 |
| 7,606,518 | B2 | 10/2009 | Koyama | |
| 7,657,211 | B2 * | 2/2010 | Kawai | 399/260 |
| 7,668,489 | B2 * | 2/2010 | Kim et al. | 399/258 |
| 7,840,165 | B2 * | 11/2010 | Okuda | 399/258 |
| 2010/0067957 | A1 | 3/2010 | Tazawa | |

FOREIGN PATENT DOCUMENTS

| | | | |
|---|---|---|---|
| JP | 09-244410 | | 9/1997 |
| JP | 2000-214667 | | 8/2000 |
| JP | 2000231252 | A * | 8/2000 |
| JP | 2004-139034 | | 5/2004 |
| JP | 2005-173052 | | 6/2005 |
| JP | 2005189691 | A * | 7/2005 |
| JP | 2006-23511 | | 1/2006 |
| JP | 2006-139067 | | 6/2006 |
| JP | 2007-249019 | | 9/2007 |
| JP | 2008-112198 | | 5/2008 |
| JP | 2008-216360 | | 9/2008 |
| JP | 2008-309858 | | 12/2008 |

* cited by examiner

*Primary Examiner* — Robert Beatty
(74) *Attorney, Agent, or Firm* — Renner, Otto, Boisselle & Sklar, LLP

(57) ABSTRACT

A toner cartridge is provided removably fitted to a toner supply pipe for supplying toner to a developing device. The toner cartridge includes, as a toner discharging mechanism, a toner discharging portion having a toner discharge port, a toner conveyor screw for conveying toner inside toner container and a shutter for opening and closing the toner discharge port. The shutter has a loosening member. When the toner cartridge is fitted to the toner supply pipe, the loosening member moves inside the toner container as the shutter moves along the toner discharge port.

12 Claims, 7 Drawing Sheets

TONER CARTRIDGE AND IMAGE FORMING APPARATUS USING THE SAME

This Nonprovisional application claims priority under 35 U.S.C §119(a) on Patent Application No. 2008-171974 filed in Japan on 1 Jul. 2008, the entire contents of which are hereby incorporated by reference.

BACKGROUND OF THE INVENTION (1) Field of the Invention

The present invention relates to a toner cartridge for use in an image forming apparatus such as a laser beam printer, multifunctional machine or the like, in particular relating to a toner cartridge for storing toner such as a replaceable toner hopper, toner bottle, etc., and an image forming apparatus using this.

(2) Description of the Prior Art

Conventionally, in image forming apparatuses based on electrophotography such as copiers, facsimile machines and the like using a dual-component developer, a toner supply device equipped with a toner cartridge or the like is used to automatically supply toner to the developing device so as to perform continuous printout of images. In such a configuration, if toner runs out, it is possible to supply toner in a simple manner by replacing the toner cartridge, process cartridge or the like.

When toner containers for a toner cartridge, process cartridge or the like are stored in a storage etc., they may be stoked without their position regulated or may be oriented in every possible direction. When, for example, toner cartridges that discharge toner from one side end of the cartridge body, are stacked and positioned vertically with the toner discharge port side down, toner in the cartridge moves down toward the toner discharge port due to gravity with the lapse of time, hence toner near the toner discharge port becomes compact. As a result, toner may aggregate or may become lumps, in the worst cases, blocking the toner discharge port.

If the toner cartridge in this condition is newly mounted, toner is unlikely to be dispensed from the toner cartridge, and it could happen, in the worst case, that it is determined that no toner remains in the toner cartridge even though a plenty amount of toner is left in it.

Particularly, since recent toner is increased in low-temperature fusing performance in order to deal with energy saving, the toner presents low storage stability and shows a tendency to easily cause toner aggregation when the toner cartridge has been left as it is.

Further, in recent image forming apparatuses, because of the demand for miniaturization, toner cartridges as well as developing devices have been downsized, and the mounting space also has become smaller. As a result, each unit is arranged closely to others, so that toner aggregation is liable to occur.

To deal with this situation, when the toner cartridge that has been put in storage is mounted to the image forming apparatus, in some products it is requested for the user etc. to set the toner cartridge after shaking it several times. However, as is often the case, the user tends to forget it, and there occurs the case that the toner will not be discharged. As a result, troubles such as insufficient toner concentration in the developer and/or stoppage of the operation of the image forming apparatus will occur.

Patent document 1 (Japanese Patent Application Laid-open 2000-214667) discloses a developer feeder in which pressure acting on the toner is reduced and excess toner supply is prevented by cutting off part of the conveyor spiral of the conveying auger in the toner cartridge.

However, patent document 1 does not refer to influence on the storage condition of the toner cartridge, hence this configuration still has the drawback or suffers from the aforementioned problem when the toner cartridge has been left behind with its toner discharge port side down under a high-temperature condition for a long time.

Accordingly, there is a demand for a simple mechanism for loosening up toner aggregation when a toner cartridge is set to an image forming apparatus body.

SUMMARY OF THE INVENTION

The present invention has been devised in view of the conventional problems, it is therefore an object of the present invention to provide a toner cartridge which can loosen the toner that is prone to aggregate therein and supply it to the developing device side by means of a simple mechanism as well as providing an image forming apparatus using this toner cartridge.

The toner cartridge and image forming apparatus according to the present invention to solve the above problem, can be configured as follows.

The first aspect of the present invention resides in a toner cartridge that is removably fitted to a toner supplying member for supplying toner to a developing device, comprising: a toner storing portion for storing toner; and a toner discharging mechanism for discharging toner from the toner storing portion to the outside, the toner discharging mechanism including: a toner discharging portion having a toner discharge port arranged at the bottom of the toner storing portion for discharging toner to the outside; a toner conveying member arranged in the toner discharging portion for conveying the toner inside the toner storing portion toward the toner discharge port; and, a shutter portion for opening and closing the toner discharge port, the shutter portion including a loosening member for loosening up the toner around the toner discharge port inside the toner storing portion, characterized in that when the toner cartridge is mounted to the toner supplying member, the toner discharging mechanism is moved approximately horizontally relative to the toner supplying member so that the shutter portion moves along the toner discharge port while the loosening member moves inside the toner storing portion, and then, the toner discharge port of the toner discharging mechanism is aligned with the toner supply port that is arranged at the top of the toner supplying member.

In the second aspect of the present invention, it is preferred that the loosening member has a projected part that is projected approximately vertically to said toner discharge port.

In the third aspect of the present invention, it is preferred the toner conveying member is moved by the projected part of the loosening member in the direction of movement of the shutter portion as the shutter portion moves.

In the fourth aspect of the present invention, it is preferred that the loosening member is formed of polyethylene terephthalate and the distal end thereof is bent so as to be projected toward the toner discharge port.

In the fifth aspect of the present invention, it is preferred that the loosening member is arranged so that the projected part comes into contact with the toner conveying member.

In the sixth aspect of the present invention, it is preferred that the loosening member is formed of an elastic porous material.

In the seventh aspect of the present invention, it is preferred that polyurethane is used as the porous material.

In the eighth aspect of the present invention, it is preferred that the opening of the toner supply port is made greater in size than that of the toner discharge port.

In the ninth aspect of the present invention, it is preferred that a sealing element is provided between the toner discharging portion and the shutter portion in the toner discharging mechanism.

In the tenth aspect of the present invention, it is preferred that the sealing element is formed of neoprene rubber In the eleventh aspect of the present invention, it is preferred that the toner conveying member includes a toner scraping plate at around the toner discharge port.

The twelfth aspect of the present invention resides in an image forming apparatus for forming an image with toner based on electrophotography, comprising: a photoreceptor drum for forming an electrostatic latent image on the surface thereof; a developing device for forming a toner image by supplying toner to the electrostatic latent image on the photoreceptor drum surface; a toner cartridge for supplying the toner to the developing device by way of a toner supplying member; a transfer device for transferring the toner image on the photoreceptor drum surface to a recording medium; and a fusing device for fusing the toner image on the recording medium, and is characterized in that the toner cartridge employs the toner cartridge having any one of the above first to eleventh aspects.

According to the first aspect of the present invention, without the need of either any special action or any motor or other drive parts, a simple attachment of the toner cartridge makes it possible to loosen toner aggregation and connect the toner container with the toner supplying member so as to enable the toner inside the toner container to be dispensed to the toner supplying member.

Accordingly, it is possible to drop aggregated toner around the toner discharging mechanism and perform correct toner supply.

According to the second aspect of the present invention, it is possible to loosen up toner aggregation with a simple structure.

According to the third aspect of the present invention, since toner aggregation of large size can be removed, it is possible to perform correct toner supply after efficient toner scraping.

According to the fourth aspect of the present invention, it is possible to provide a simple structure having appropriate rigidity and restoration performance.

According to the fifth aspect of the present invention, since minute vibration can be added to the toner conveying member, it is possible to drop off the toner in a more reliable manner.

According to the sixth aspect of the present invention, since the porous material is reduced in volume as the shutter portion is released, it is possible to put up the loosening member between the toner storing portion and the shutter portion while keeping toner loosening effect without causing any hindrance to toner dropping.

According to the seventh aspect of the present invention, it is possible to easily form the loosening member.

According to the eighth aspect of the present invention, it is possible to hold down the spilling of toner around the shutter portion.

According to the ninth aspect of the present invention, it is possible to reliably prevent toner from scattering and leaking.

According to the tenth aspect of the present invention, it is possible to provide a sealing element excellent in weather resistance.

According to the eleventh aspect of the present invention, it is possible to efficiently scrape off the toner that has aggregated around the toner discharge port as the toner conveying member rotates.

According to the twelfth aspect of the present invention, it is possible to keep the image forming apparatus clean and free from toner scattering and toner leakage.

DESCRIPTION OF THE PREFERRED EMBODIMENTS

The best mode for carrying out the present invention will hereinafter be described in detail with reference to the drawings.

Figure 1:
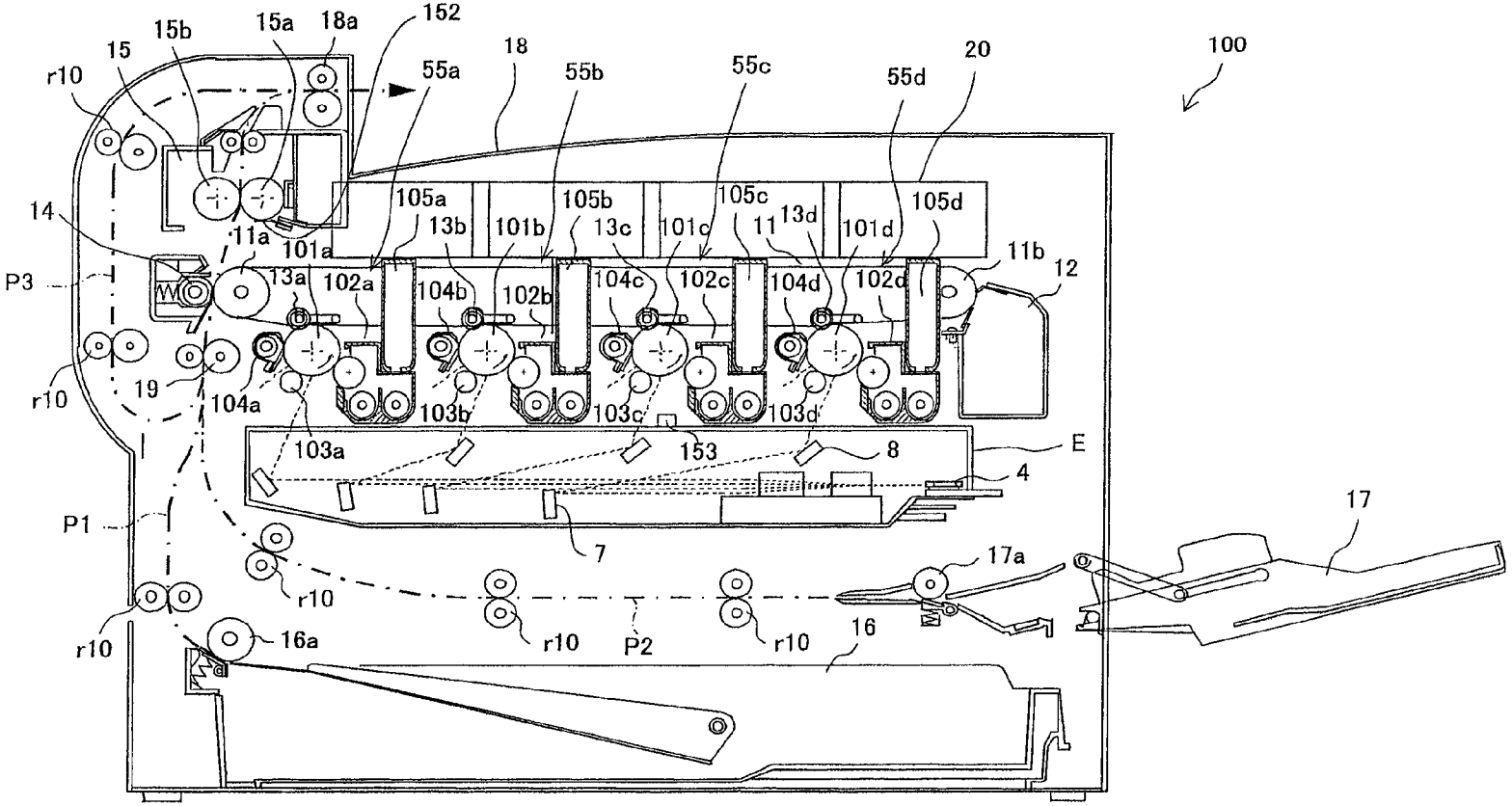
FIG. 1 is an illustrative view showing an overall configuration of an image forming apparatus according to the embodiment of the present invention.

FIG. 1 is an illustrative view showing an overall configuration of an image forming apparatus according to the embodiment of the present invention.

An image forming apparatus 100 of the present embodiment including: as shown in FIG. 1, photoreceptor drums 101 on the surface of which electrostatic latent images are formed;

developing devices 102 for supplying toner to the photoreceptor drums 101 surface to develop the electrostatic latent images into toner images; toner cartridges 200 for supplying toner to developing devices 102 through toner supply pipes (toner supplying members) 105; a secondary transfer roller (transfer device) 14 for transferring the toner image from the photoreceptor drums 101 surface to the paper through an intermediate transfer belt 11; and a fusing unit 15 for fusing the toner image to the paper, forms images using the toner based on electrophotography.

To begin with, the overall configuration of image forming apparatus 100 will be described.

Image forming apparatus 100 of the present embodiment forms a visual image printout of a multi-colored or monochrome image on a predetermined sheet (recording paper) in accordance with image data contained in an input command, such as image data and the like transmitted from the outside by way of a communication network or the like. This image forming apparatus 100 includes: as shown in FIG. 1, an exposure unit E; photoreceptor drums 101 (101*a* to 101*d*) corresponding to image bearers on which latent images are formed by the exposure unit E; developing units 102 (102*a* to 102*d*); charging rollers 103 (103*a* to 103*d*); cleaning units 104 (104*a* to 104*d*); intermediate transfer belt 11; primary transfer rollers 13 (13*a* to 13*d*); secondary transfer roller 14; fusing unit 15; paper feed paths P1, P2 and P3; a paper feed cassette 16; a manual paper feed tray 17; a paper output tray 18; a toner cartridge unit 20.

The image data for a color image handled in this image forming apparatus 100 is formed of image data of four colors, i.e., black (K), cyan (C), magenta (M) and yellow (Y), and the image forming apparatus forms a visual image by means of image forming portions 55 (55*a* to 55*d*), which correspond to the above four colors.

Accordingly, four developing units 102 (102*a* to 102*d*), photoreceptor drums 101 (101*a* to 101*d*), charging rollers 103 (103*a* to 103*d*) and cleaning units 104 (104*a* to 104*d*) are provided so as to form four latent images for four different colors.

All the image forming portions 55*a* to 55*d* have the same configurations, for example black image forming portion 55*a* is composed of photoreceptor drum 101*a*, developing unit 102*a*, charging roller 103*a*, transfer roller 13*a* and cleaning unit 104*a* and the like.

These image forming portions 55*a* to 55*d* are arranged in a row in the intermediate transfer belt 11's direction of movement (sub scan direction). Here, the symbols a to d are used so that 'a' corresponds to black, 'b' to cyan, 'c' to magenta and 'd' to yellow. The devices designated by each symbol form one imaging station, that is, four imaging stations are provided.

Exposure unit E as the light exposure device in the present embodiment includes an unillustrated semiconductor laser, a polygon mirror 4, a first reflecting mirror 7 and a second reflecting mirror 8, and illuminates photoreceptor drums 101*a* to 101*d* with light beams, i.e., laser beams, that are modulated based on image data of separate colors, that is, black, cyan, magenta and yellow. Formed on photoreceptor drums 101*a* to 101*d* are electrostatic latent images based on image data of respective colors of black, cyan, magenta and yellow.

Though exposure unit E of the present embodiment is based on a technique using a laser scanning unit (LSU) equipped with a laser emitter and reflection mirrors, other methods using an array of light emitting elements such as an EL or LED writing head, for example may be used instead.

Photoreceptor drum 101 is an essentially cylindrical image bearer, which is arranged above exposure unit E, and is controlled by an unillustrated driving device and control device so as to rotate in a predetermined direction. Photoreceptor drum 101 is composed of a base member and a photoconductive layer formed thereon. For example, the photoreceptor drum may be formed of a metallic base drum of aluminum or the like and a thin film of a photo conductive layer of amorphous silicon (a-Si), selenium (Se), organic photoconductor (OPC) or the like, formed on the outer peripheral surface of the base member. The configuration of photoreceptor drum 101 is not particularly limited to the above.

Charging roller 103 is a charging device of a contact type which uniformly electrifies the photoreceptor drum 101 surface at a predetermined potential. In the present embodiment, contact roller-type charging roller 103 is used as shown in FIG. 1, a charger of a corona discharging type or a brush type may be used instead of charging roller 103.

Developing unit 102 supplies toner to the photoreceptor drum 101 surface with an electrostatic latent image formed thereon to develop the latent image into a toner image. Developing units 102*a* to 102*d* store black, cyan, magenta and yellow color toners, respectively so as to develop the electrostatic latent images for colors formed on photoreceptor drums 101*a* to 101*d* into toner images of black, cyan, magenta and yellow colors.

Cleaning unit 104 removes and collects the toner remaining on the photoreceptor drum 101 surface after development and image transfer, using a lubricant or the like.

Intermediate transfer belt 11 arranged over photoreceptor drums 101 is wound and tensioned between a drive roller 11*a* and a driven roller 11*b*, forming a loop-like moving path. Arranged opposing the outer peripheral surface of intermediate transfer belt 11 are photoreceptor drum 101*d*, photoreceptor drum 101*c*, photoreceptor drum 101*b* and photoreceptor drum 101*a* in the order mentioned.

Primary transfer rollers 13*a* to 13*d* are arranged at positions opposing respective photoreceptor drums 101*a* to 101*d* with this intermediate transfer belt 11 held therebetween. The areas where intermediate transfer belt 11 opposes photoreceptor drums 101*a* to 101*d* form respective primary transfer positions. This intermediate transfer belt 11 is formed of an endless film of about 100 to 150 μm thick.

In order to transfer the toner images carried on the surfaces of photoreceptor drums 101*a* to 101*d* to intermediate transfer belt 11, each of primary transfer rollers 13*a* to 13*d* is applied by constant-voltage control at a primary transfer bias that has the opposite polarity to that of the charge on the toner. With this arrangement, the toner images of individual colors formed on photoreceptor drums 101 (101*a* to 101*d*) are successively transferred to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photoreceptor drums 101*a* to 101*d* electrostatic latent images and hence toner images are formed only for the photoreceptor drums 101 that correspond to the colors of the input image data. For example, upon monochrome image forming, the electrostatic latent image and toner image for photoreceptor drum 101*a* corresponding to black color is formed, so that the black toner image alone is transferred to the outer peripheral surface of intermediate transfer belt 11.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.,) coated on the shaft surface, and uniformly applies a high voltage to intermediate transfer belt 11 through the conducive elastic material. Though in the present embodiment, primary transfer rollers 13*a* to 13*d* are used as the transfer electrodes, brushes and the like can also be used in their place.

The toner image transferred to the outer peripheral surface of intermediate transfer belt 11 at each primary transfer position is conveyed as intermediate transfer belt 11 circulates to the secondary transfer station where the belt opposes secondary transfer roller 14. During image forming, secondary transfer roller 14 is abutted with a predetermined nip pressure against the outer peripheral surface of intermediate transfer belt 11, in the area where the interior side of intermediate transfer belt 11 comes into contact with the peripheral surface of drive roller 11*a*. In order to obtain constant nip pressure, either secondary transfer roller 14 or intermediate transfer belt drive roller 11*a* is formed of a hard material such as metal or the like while the other is formed of a soft material such as an elastic roller or the like (elastic rubber roller, foamed resin roller etc.).

When the paper fed from paper feed cassette 16 or manual paper feed tray 17 passes through the nip between secondary transfer roller 14 and intermediate transfer belt 11, a high voltage of a polarity (+) opposite to the polarity (−) of the electrostatic charge on the toner is applied to secondary transfer roller 14. In this way, the electrostatic latent images formed on photoreceptor drums 101 (101*a* to 101*d*) are visualized with the corresponding color toners, forming respective toner images, which are transferred to intermediate transfer belt 11 in a layered manner. Then the thus layered toner image is moved as intermediate transfer belt 11 circulates to the contact position between the paper being conveyed and intermediate transfer belt 11, so that the toner image is transferred from the outer peripheral surface of intermediate transfer belt 11 to the paper by means of secondary transfer roller 14.

Since the toner adhering to intermediate transfer belt 11 as the belt comes in contact with photoreceptor drums 101, or the toner which has not been transferred from intermediate transfer belt 11 to the paper during transfer of the toner image and remains on intermediate transfer belt 11, would cause contamination of color toners at the next operation, it is removed and collected by an intermediate transfer belt cleaning unit 12. Intermediate transfer belt cleaning unit 12 includes a cleaning blade, for example as a cleaning member that comes into contact with intermediate transfer belt 11. Intermediate transfer belt 11 is supported from its interior side by intermediate transfer belt driven roller 11*b*, at the portion where this cleaning blade comes into contact with intermediate transfer belt 11.

The paper with the toner image as a visual image transferred thereon is lead to fusing unit 15 having a heat roller 15*a* and a pressing roller 15*b* and undergoes heating and pressing treatment while passing through and between heat roller 15*a* and pressing roller 15*b*. Thereby, the toner image as a visual image is firmly fixed to the paper surface. The paper with the toner image fused thereon is discharged by a paper discharge roller 18*a* onto paper output tray 18.

Image forming apparatus 100 includes a paper feed path P1 that extends approximately vertically to convey the paper from paper feed cassette 16 to paper output tray 18 by way of the nip between secondary transfer roller 14 and intermediate transfer belt 11 and fusing unit 15.

Arranged along paper feed path P1 are a pickup roller 16*a* for delivering the paper from paper feed cassette 16, one sheet at a time, into paper feed path P1, conveying rollers r10 for conveying the delivered paper upwards, a registration roller 19 for leading the conveyed paper to the nip between secondary transfer roller 14 and intermediate transfer belt 11 at a predetermined timing and paper discharge roller 18*a* for discharging the paper to paper output tray 18.

Image forming apparatus 100 also incorporates a paper feed path P2 that extends from manual paper feed tray 17 to registration roller 19, having a pickup roller 17*a* and conveying rollers r10 arranged therealong. There is also another paper feed path P3 that extends from paper discharge roller 18*a* toward the upstream side of registration roller 19 in paper feed path P1.

Paper discharge roller 18*a* is adapted to be rotatable in both forward and reverse directions, and is rotated in the forward direction to discharge the paper to paper output tray 18 at the time of one-sided image forming for forming an image on one side of the paper and at the time of the second side image forming in duplex image forming for forming images on both sides.

On the other hand, at the time of the first side image forming in duplex image forming, paper discharge roller 18*a* is driven in the forward direction until the rear end of the paper passes by fusing unit 15 and then rotated in reverse while it is holding the rear end of the paper to lead the paper into paper feed path P3. Thereby, the paper with an image formed on the first side during duplex image forming is lead to paper feed path P1 with its printed face down and its front edge inverted to the rear.

Registration roller 19 leads the paper that has been fed from paper feed cassette 16 or manual paper feed tray 17 or that has been conveyed through paper feed path P3, to the nip between secondary transfer roller 14 and intermediate transfer belt 11 at a timing synchronized with the rotation of intermediate transfer belt 11. For this purpose, registration roller 19 stops rotating when photoreceptor drums 101 and intermediate transfer belt 11 start to operate while the paper that was started to be fed or conveyed in advance of rotation of intermediate transfer belt 11 is stopped from moving in paper feed path P1 with its front end abutting against registration roller 19. Thereafter, registration roller 19 starts to rotate at such a timing that the front edge of the paper and the front end of the toner image formed on intermediate transfer belt 11 meet each other at the position where secondary transfer roller 14 and intermediate transfer belt 11 come in press-contact with each other.

Here, when full-color image forming is performed with all the image forming portions 55*a* to 55*d*, primary transfer rollers 13*a* to 13*d* are adapted to abut intermediate transfer belt 11 against respective photoreceptor drums 101*a* to 101*d*. On the other hand, when monochrome image forming is performed with image forming portion 55*a* alone, primary transfer roller 13*a* alone is adapted to abut intermediate transfer belt 11 against photoreceptor drum 101*a*.

Next, the configuration of toner cartridge 200 according to the present embodiment will be described in detail with reference to the drawings.

Figure 2:
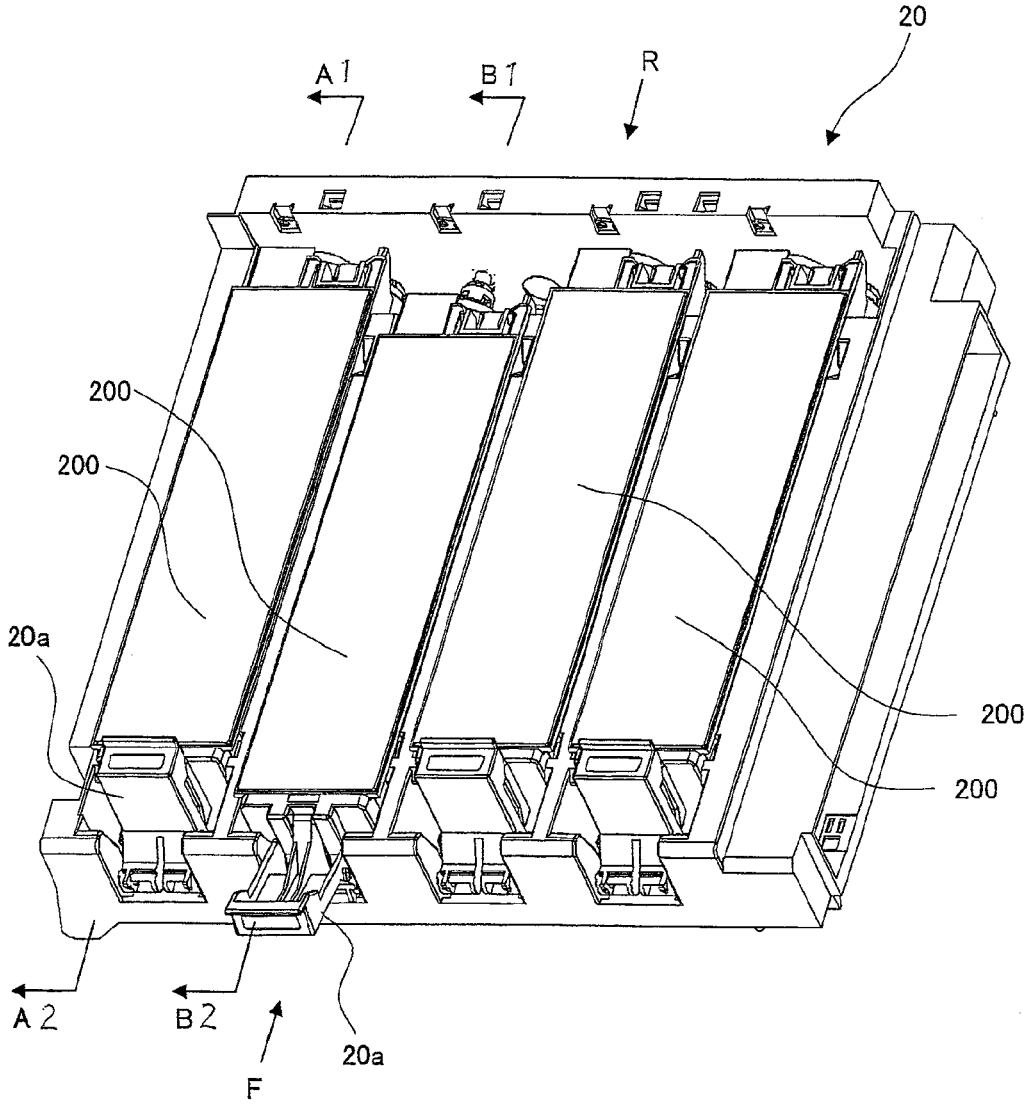
FIG. 2 is a perspective view showing a configuration of a toner cartridge unit including toner cartridges, mounted on the same image forming apparatus.
Figure 3A:
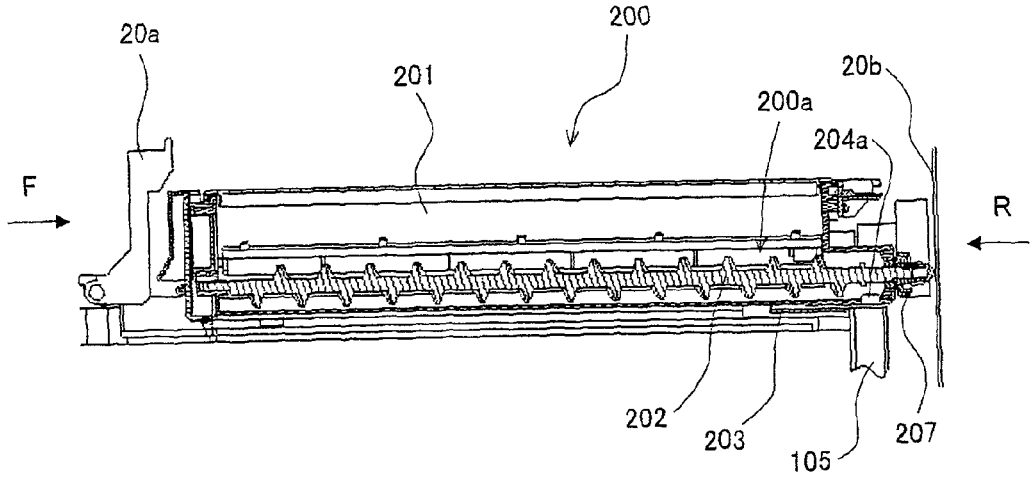
FIG. 3A is a sectional view cut along a plane A1-A2 in FIG. 2.
Figure 3B:
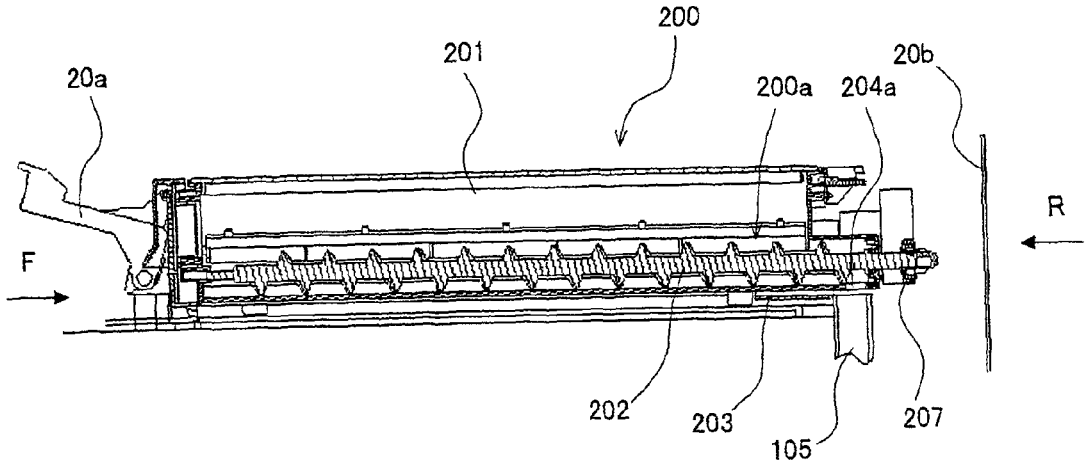
FIG. 3B is a sectional view cut along a plane B1-B2 in FIG. 2.
Figure 4B:
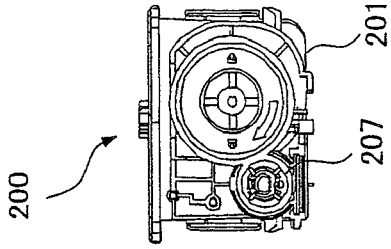
FIG. 4B is a side view when viewed in the direction of arrow R in FIG. 4A.
Figure 4A:
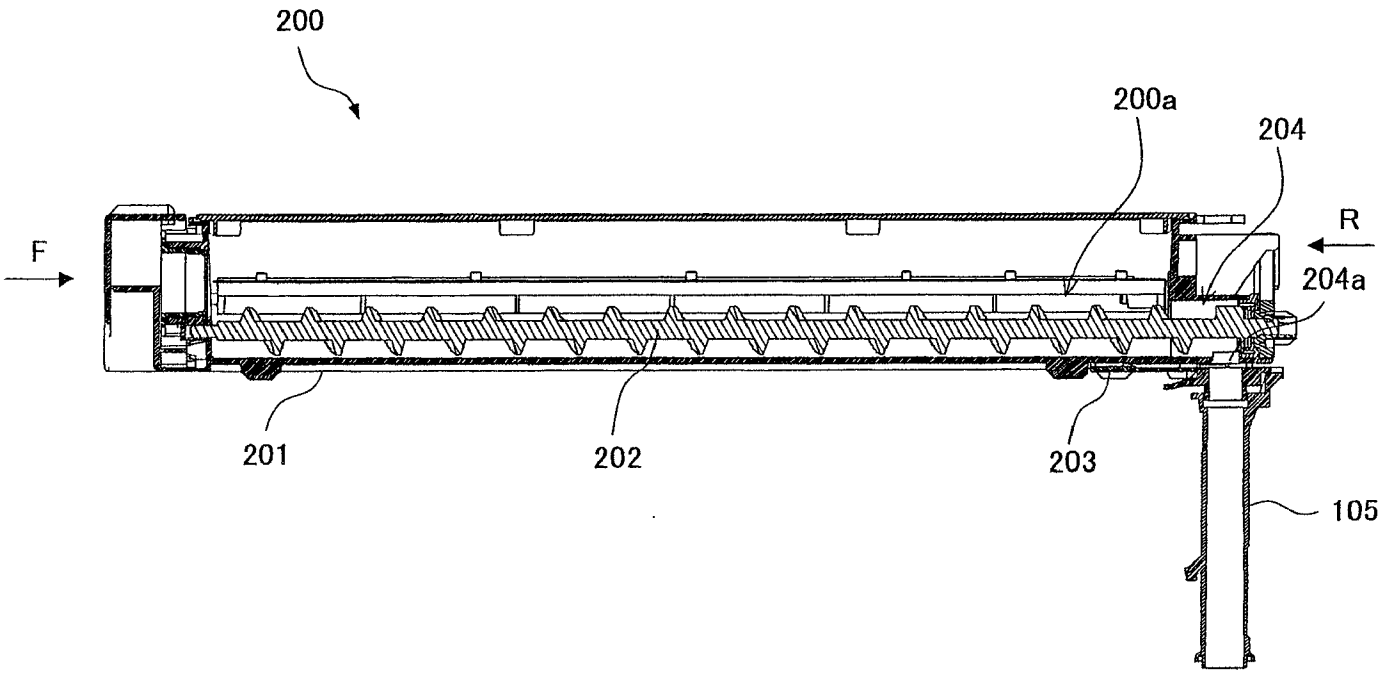
FIG. 4A is a side sectional view showing the toner cartridge fitted to a toner supply pipe.

FIG. 2 is a perspective view showing a configuration of a toner cartridge unit including toner cartridges, mounted of the image forming apparatus according to the present embodiment; FIG. 3A is a sectional view cut along a plane A1-A2 in FIG. 2; FIG. 3B is a sectional view cut along a plane B1-B2 in FIG. 2; FIG. 4A is a side sectional view showing the toner cartridge set to a toner supply pipe; and FIG. 4B is a side view when viewed in the direction of arrow R in FIG. 4A. Here, the toner cartridge 200, shown second from the left in FIG. 2 is situated before it is mounted to toner cartridge unit 20.

In the present embodiment, four toner cartridges 200 are arranged side by side on toner cartridge unit 20, as shown in FIG. 2. Each toner cartridge 200 includes, as shown in FIGS. 3A and 3B, a toner container (toner storing portion) 201 and a toner discharging mechanism 200*a* for discharging toner from toner container 201 to the outside.

Toner discharging mechanism 200*a* includes, as shown in FIG. 4A, a toner discharging portion 204, a toner conveyor screw (toner conveying member) 202 and a toner supply port shutter (shutter portion) 203.

Toner discharging portion 204 has a toner discharge port 204*a* arranged at the bottom of toner container 201 for discharging toner stored in toner container 201 to the outside.

Toner conveyor screw 202 is arranged in toner discharging portion 204 and conveys the toner inside toner container 201 toward toner discharge port 204*a*. Here, a reference numeral 207 (FIG. 4B) is a gear for transmitting drive to toner conveyor screw 202.

Toner supply port shutter 203 is formed of a plate-shaped member that is slidably arranged on and along the outer bottom surface of toner container 201 in the axial direction of toner conveyor screw 202, and opens and close toner discharge port 204*a* as it slides.

As shown in FIGS. 3A and 3B, as a lock lever 20*a* is raised, toner container (toner storing portion) 201 is moved rightwards (in the direction of arrow F, along the axial direction of toner conveyor screw 202) until it abuts a stopper plate 20*b*, where toner cartridge 200 is engaged in place. In this movement, toner container 201 moves approximately horizontally (in the F-direction) along the opening of toner supply pipe 105 as shown in FIG. 4A while toner supply port shutter 203 is constrained from moving in the F-direction by toner supply pipe 105. As a result, toner discharge port 204*a* gradually moves relative to toner supply port shutter 203 as toner container 201 moves, and is released from toner supply port shutter 203. The toner discharge port is fully opened at the position where it opposes the opening of toner supply pipe 105. In this position, the toner cartridge is set into the condition where toner can be supplied from toner container (toner storing portion) 201 to the opening of toner supply pipe 105 through toner discharge port 204*a*.

Here, it is preferred that the opening of toner supply pipe 105 is larger in size than the opening of toner discharge port 204*a*.

EXAMPLE 1

Now, one example of the toner cartridge of the present embodiment will be described with reference to the drawings.

Figure 5A:
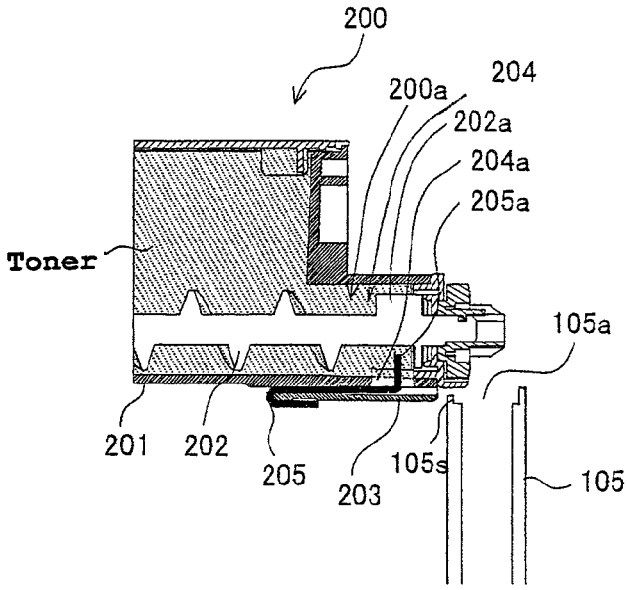
FIG. 5A is a partial sectional view showing example 1 of a toner cartridge of the present embodiment with its shutter closed.
Figure 5B:
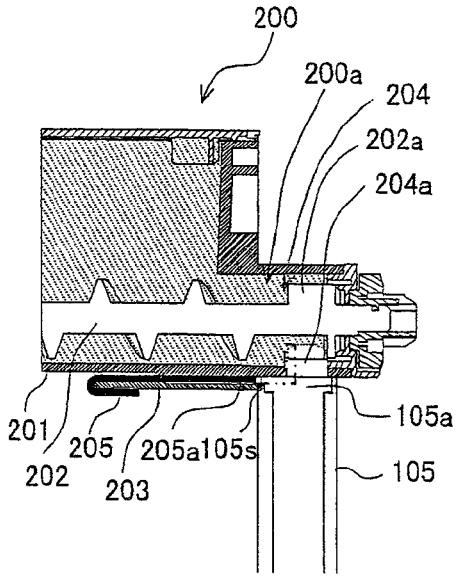
FIG. 5B is a partial sectional view showing the same toner cartridge as above with its shutter open.
Figure 5C:
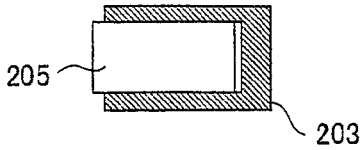
FIG. 5C is a top view showing a positional relationship between the shutter in the toner cartridge and a loosening member.
Figure 5D:
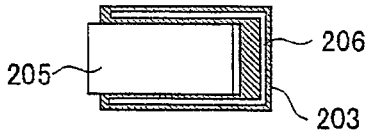
FIG. 5D is a top view showing a state where a sealing element is arranged with the shutter in the toner cartridge.

FIG. 5A is a partial sectional view showing example 1 of a toner cartridge of the present embodiment with its shutter closed; FIG. 5B is a partial sectional view showing the same toner cartridge as above with its shutter open; FIG. 5C is a top view showing a positional relationship between the shutter in the toner cartridge and a loosening member; and FIG. 5D is a top view showing a state where a sealing element is arranged with the shutter in the toner cartridge.

Toner cartridge unit 20 including toner cartridges 200 are arranged over developing units 102 and joined with toner supply pipes 105 to supply toner to developing units 102, as shown in FIG. 1.

Toner cartridge 200 has a toner discharging mechanism 200*a* including a toner discharging portion 204, a toner conveyor screw 202 and a toner supply port shutter 203, as shown in FIG. 5A.

This toner cartridge 200, basically, whether there is toner aggregation or not, prevents toner from falling from toner discharge port 204*a* disposed at the bottom of toner container 201 by toner supply port shutter 203 arranged under toner conveyor screw 202, as shown in FIG. 5A.

Toner supply port shutter 203 is provided with a loosening member 205.

This loosening member 205 is a rectangular plate-shaped element, and is formed with toner supply port shutter 203 so as to be movable with toner supply port shutter 203.

Formed at one end of loosening member 205 is a projection 205*a* for moving and loosening up the toner around toner discharge port 204*a*. The other end on the opposite side from projection 205*a* is folded back so as to cover the end of toner supply port shutter 203.

Projection 205*a* is positioned approximately perpendicularly to toner supply port shutter 203 when toner supply port shutter 203 closes toner discharge port 204*a*, so that its bent part passes through toner discharge port 204*a* to enter the interior of toner container 201 and reach the toner conveying region of toner conveyor screw 202.

Projection 205*a* may have any size and shape as long as it is movable through toner discharge port 204*a*. In this embodiment, the projection has a rectangular shape.

When toner discharge port 204*a* is closed by toner supply port shutter 203, projection 205*a* needs to be positioned so that it will be able to move inside toner discharge port 204*a* from when toner discharge port 204*a* is closed until it is opened. However, it is more preferable if the projection is positioned so as to be able to move by as much the distance as the length of toner discharge port 204*a*.

Loosening member 205 may be formed of any deformable material as long as it can realize the function described below. In the present embodiment, polyethylene terephthalate film of 0.5 mm thick (PET, trade name: Mylar, a product of Teijin DuPont Films) is used. That is, the loosening member is required to deform so that projection 205*a* falls down along toner supply port shutter 203 when toner supply port shutter 203 releases toner discharge port 204*a*.

Next, the operation will be described.

When toner cartridge 200 is set to toner supply pipe 105, shutter 203 of toner discharging mechanism 200*a* is moved approximately horizontally relative to toner supply pipe 105, so that shutter 203 moves in the approximately horizontal direction with respect to toner discharge port 204*a*. As a result, loosening member 205 moves inside toner container 201. Then, toner discharge port 204*a* is moved until it opposes, and becomes aligned with, toner supply port 105*a* of toner supply pipe 105.

Specifically, when toner cartridge 200 is mounted to the apparatus body, shutter 203 collides with a stopper 105s (a stopper provided in toner supply pipe 105, for example) provided inside the insert passage. Then, while shutter 203 relatively moves leftwards in the drawing with respect to toner container 201, projection 205*a* of loosening member 205 provided for shutter 203 also moves leftwards relatively inside toner discharge port 204*a*, as shown in FIG. 5B. As a result, the toner near projection 205*a* is loosened up and begins to drop from toner discharge port 204*a*.

As shutter 203 moves leftwards, projection 205*a* becomes held between toner container 201 and shutter 203. As the shutter is further moved, the projection is entirely put up between toner container 201 and shutter 203, and thereafter, it will never disturb toner supply.

Further, in order to scrape off the toner near toner discharge port 204*a*, a toner scraper plate 202*a* of a rectangular shape, for example, is projectively formed on toner conveyor screw 202. Since this arrangement makes toner scraper plate 202*a* rotate as toner conveyor screw 202 turns, even if toner aggregation cannot be removed completely by the movement of loosening member 205 it is possible to easily scrape off the toner near toner discharge port 204*a*.

Since in this example, use of PET for loosening member 205*c* an provide appropriate rigidity and will exert no chemical influence on the toner, it is possible for projection 205*a* to repeatedly recover its original condition even in the opening closing operation of the shutter.

It should be noted that, when viewed from top in FIG. 5C, shutter 203 is designed to be greater than loosening member 205 so as not to cause any toner leakage from toner discharge port 204*a*.

Further, as shown in FIG. 5D, a sealing element 206 is arranged around shutter 203 so as to enclose the periphery of loosening member 205, to thereby prevent toner scattering. For this sealing element 206, neoprene rubber or the like, which will not chemically react with the toner and presents high strength, is suitably used.

EXAMPLE 2

Next, example 2 of the toner cartridge of the present embodiment will be described.

Figure 6A:
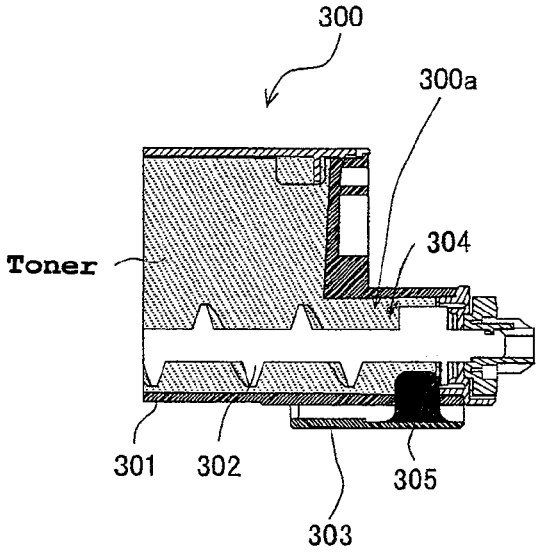
FIG. 6A is a partial sectional view showing example 2 of a toner cartridge according to the present embodiment with its shutter closed.
Figure 6B:
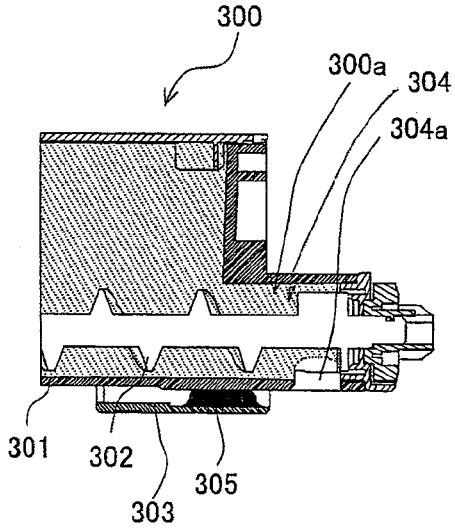
FIG. 6B is a partial sectional view showing the same toner cartridge as above with its shutter open.
Figure 6C:
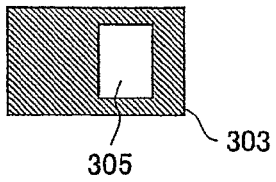
FIG. 6C is a top view showing a positional relationship between the shutter in the toner cartridge and a loosening member.
Figure 6D:
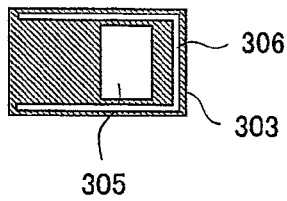
FIG. 6D is a top view showing a state where a sealing element is arranged with the shutter in the toner cartridge.

FIG. 6A is a partial sectional view showing example 2 of a toner cartridge according to the present embodiment with its shutter closed; FIG. 6B is a partial sectional view showing the same toner cartridge as above with its shutter open; FIG. 6C is a top view showing a positional relationship between the shutter in the toner cartridge and a loosening member; and FIG. 6D is a top view showing a state where a sealing element is arranged with the shutter in the toner cartridge.

As shown in FIGS. 6A and 6B, atoner cartridge 300 includes: a toner discharging portion 304 having a toner discharge port 304*a* arranged at the bottom of a toner container 301 for discharging toner to the outside; a toner conveyor screw 302 arranged in toner discharging portion 304 for conveying the toner inside toner container 301 toward toner discharge port 304*a*; a shutter 303 for opening and closing toner discharge port 304*a*.

Toner discharging mechanism 300*a* in toner cartridge 300 has the same basic configuration as that of toner discharging mechanism 200*a* of example 1.

A loosening member 305 is projectively formed on shutter 303 as shown in FIG. 6A, having a size and shape that tightly fits and passes through toner discharge port 304*a* to reach the toner conveying region of toner conveyor screw 302.

Loosening member 305 may be formed of elastic polyurethane (polyurethane foam ERG-S, a product of INOAC Foam Company).

Use of the aforementioned material for loosening member 305 makes it possible to put up the loosening member into the space between the shutter and toner container 301 with a relatively small force resulting from movement of shutter 303, as shown in FIGS. 6A and 6B.

Further, as shown in FIG. 6D, a sealing element 306 is arranged around shutter 303 so as to enclose the periphery of loosening member 305, to thereby prevent toner scattering.

EXAMPLE 3

Next, example 3 of the toner cartridge of the present embodiment will be described.

Figure 7A:
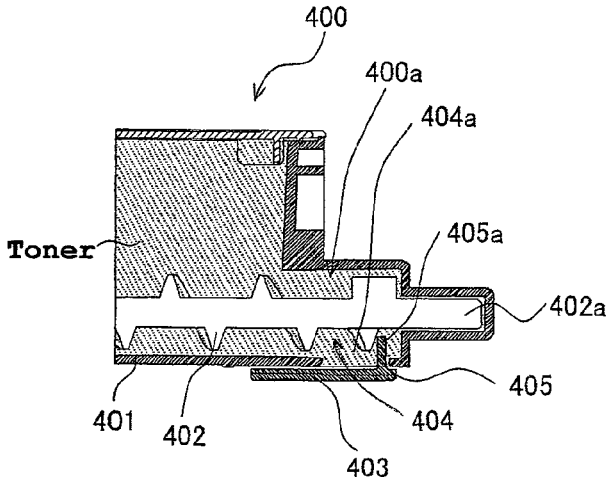
FIG. 7A is a partial sectional view showing example 3 of a toner cartridge according to the present embodiment with its shutter closed.
Figure 7B:
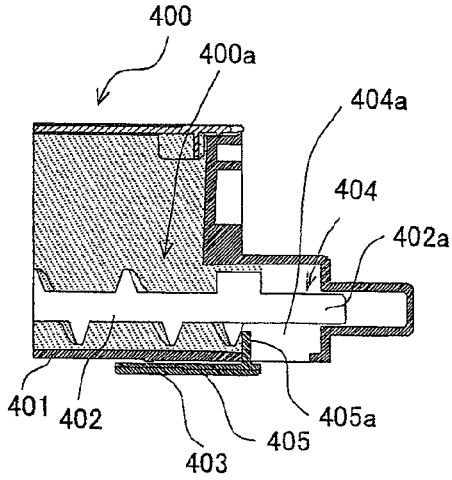
FIG. 7B is a partial sectional view showing the same toner cartridge as above with its shutter open.
Figure 7C:
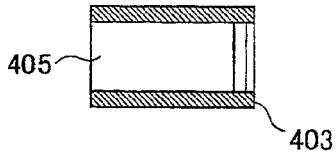
FIG. 7C is a top view showing a positional relationship between the shutter in the toner cartridge and a loosening member; and, FIG. 7D is a top view showing a state where a sealing element is arranged with the shutter in the toner cartridge.
Figure 7D:
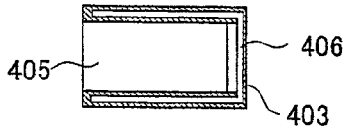

FIG. 7A is a partial sectional view showing example 3 of a toner cartridge according to the present embodiment with its shutter closed; FIG. 7B is a partial sectional view showing the same toner cartridge as above with its shutter open; FIG. 7C is a top view showing a positional relationship between the shutter in the toner cartridge and a loosening member; and FIG. 7D is a top view showing a state where a sealing element is arranged with the shutter in the toner cartridge.

As shown in FIGS. 7A and 7B, a toner cartridge 400 includes: a toner discharging portion 404 having a toner discharge port 404*a* arranged at the bottom of a toner container 401 for discharging toner to the outside; a toner conveyor screw 402 arranged in toner discharging portion 404 for conveying the toner inside toner container 401 toward toner discharge port 404*a*; a shutter 403 for opening and closing toner discharge port 404*a*.

Toner discharging mechanism 400*a* in toner cartridge 400 has the same basic configuration as that of the toner discharging mechanisms of examples 1 and 2.

A loosening member 405 is formed of ABS resin, PS resin or the like and has a projection 405*a* as shown in FIGS. 7A and 7B. This loosening member 405 is integrally formed with shutter 403, having the same configuration as that of loosening member 205 with projection 205*a* of example 1 that is projectively formed upright.

Toner conveyor screw 402 is formed longer at one axial end 402*a* so that toner conveyor screw 402 can provide a function to guide movement in the left and right directions in the drawing.

That is, with an opening and closing action of shutter 403, loosening member 405 moves toner conveyor screw 402 leftwards in the drawing, whereby it is possible to drop the toner around toner conveyor screw 402 near toner discharge port 404.

Further, as shown in FIG. 7D, a sealing element 406 is arranged around shutter 403 so as to enclose the periphery of loosening member 405, to thereby prevent toner scattering.

Though not illustrated, in this example toner conveyor screw 402 is adapted to be driven on the left side.

According to the embodiment and examples thus constructed as above, shutter 203, 303 or 403 of toner discharging mechanism 200*a*, 300*a* or 400*a* in toner cartridges 200, 300 or 400 is formed with loosening member 205, 305 or 405, and loosening member 205, 305 or 405 is adapted to move with an opening and closing action of shutter 203, 303 or 403. Accordingly, it is possible with a simple configuration to easily loosen up the toner that is prone to aggregate around toner discharge port 204*a*, 304*a* or 404*a* inside toner cartridge 200, 300 or 400.

Having described the preferred embodiment and examples of the present invention with reference to the attached drawings, it goes without saying that the present invention should not be limited to the above-described examples. It is obvious that various changes and modifications will occur to those skilled in the art within the scope of the appended claims. Such variations are therefore understood to be within the technical scope of the present invention.

What is claimed is:

1. A toner cartridge that is removably fitted to a toner supplying member for supplying toner to a developing device, comprising:

a toner storing portion for storing toner; and a toner discharging mechanism for discharging toner from the toner storing portion to the outside, the toner discharging mechanism including:

a toner discharging portion having a toner discharge port arranged at the bottom of the toner storing portion for discharging toner to the outside;

a toner conveying member arranged in the toner discharging portion for conveying the toner inside the toner storing portion toward the toner discharge port; and, a shutter portion for opening and closing the toner discharge port, the shutter portion including a loosening member for loosening up the toner around the toner discharge port inside the toner storing portion, characterized in that when the toner cartridge is mounted to the toner supplying member, the toner discharging mechanism is moved approximately horizontally relative to the toner supplying member so that the shutter portion moves along the toner discharge port while the loosening member moves inside the toner storing portion, and then, the toner discharge port of the toner discharging portion is aligned with the toner supply port that is arranged at the top of the toner supplying member.

2. The toner cartridge according to claim 1, wherein the loosening member has a projected part that is projected approximately vertically to said toner discharge port.

3. The toner cartridge according to claim 2, wherein the projected part of the loosening member moves the toner conveying member in the direction of movement of the shutter portion as the shutter portion moves.

4. The toner cartridge according to claim 1, wherein the loosening member is formed of polyethylene terephthalate and the distal end thereof is bent so as to be projected toward the toner discharge port.

5. The toner cartridge according to claim 1, wherein the loosening member is arranged so that the projected part comes into contact with the toner conveying member.

6. The toner cartridge according to claim 1, wherein the loosening member is formed of an elastic porous material.

7. The toner cartridge according to claim 6, wherein the porous material is polyurethane.

8. The toner cartridge according to claim 1, wherein the opening of the toner supply port is greater in size than that of the toner discharge port.

9. The toner cartridge according to claim 1, wherein a sealing element is provided between the toner discharging portion and the shutter portion in the toner discharging mechanism.

10. The toner cartridge according to claim 9, wherein the sealing element is formed of neoprene rubber.

11. The toner cartridge according to claim 1, wherein the toner conveying member includes a toner scraping plate at around the toner discharge port.

12. An image forming apparatus for forming an image with toner based on electrophotography, comprising:

a photoreceptor drum for forming an electrostatic latent image on the surface thereof;

a developing device for forming a toner image by supplying toner to the electrostatic latent image on the photoreceptor drum surface;

a toner cartridge for supplying the toner to the developing device by way of a toner supplying member;

a transfer device for transferring the toner image on the photoreceptor drum surface to a recording medium; and a fusing device for fusing the toner image on the recording medium, characterized in that the toner cartridge employs the toner cartridge defined in claim 1.

* * * * *